US005951028A

United States Patent [19]

Lovitt et al.

[11] Patent Number: 5,951,028

[45] Date of Patent: Sep. 14, 1999

[54] ROLLER SKATE

[75] Inventors: Bert Lovitt, Pacific Palisades, Calif.; Warren Winslow, Galena, Ill.

[73] Assignee: Land Roller, Inc., Pacific Palisades, Calif.

[21] Appl. No.: 08/901,118

[22] Filed: Jul. 28, 1997

[51] Int. Cl.[6] ..... A63C 17/06

[52] U.S. Cl. ..... 280/11.22; 280/11.2

[58] Field of Search ..... 280/11.24, 11.2, 280/11.23, 11.22, 11.27

[56] References Cited

U.S. PATENT DOCUMENTS

| | | | |
|---|---|---|---|
| 89,833 | 5/1869 | Luders . | |
| 92,936 | 7/1869 | Brownlee . | |
| 189,285 | 4/1877 | True . | |
| 256,765 | 4/1882 | Thompson . | |
| 314,812 | 3/1885 | Elliott . | |
| 346,664 | 8/1886 | Libbey | 280/11.27 |
| D. 347,044 | 5/1994 | Slack et al. . | |
| 363,716 | 5/1887 | Yost . | |
| 504,226 | 8/1893 | Leedham . | |
| 572,403 | 12/1896 | Bond . | |
| 573,096 | 12/1896 | Marteeny . | |
| 591,925 | 10/1897 | Kimbrough . | |
| 889,580 | 6/1908 | Carlsson . | |
| 1,023,882 | 4/1912 | Schiesari . | |
| 1,149,912 | 8/1915 | Harrell . | |
| 1,176,074 | 3/1916 | Malcolm . | |
| 1,552,541 | 9/1925 | Clark . | |
| 1,846,265 | 2/1932 | Lang . | |
| 1,975,661 | 10/1934 | Powell | 280/11.27 |
| 2,198,857 | 9/1940 | Branson . | |
| 2,212,589 | 8/1940 | Decker . | |
| 2,430,037 | 11/1947 | Vincent | 280/11.27 |
| 2,520,793 | 10/1950 | Blackwell . | |
| 2,675,243 | 4/1954 | King . | |
| 2,931,012 | 3/1960 | Kosach . | |
| 2,980,436 | 4/1961 | Kosach . | |
| 2,996,306 | 8/1961 | Johnson . | |
| 3,663,031 | 5/1972 | Young . | |
| 3,877,710 | 4/1975 | Nyitrai . | |
| 3,885,804 | 5/1975 | Cudmore | 280/11.24 |
| 4,194,751 | 3/1980 | Shinmura . | |
| 4,310,168 | 1/1982 | Macaluso . | |
| 4,323,259 | 4/1982 | Boudreau . | |
| 4,363,493 | 12/1982 | Veneklasen . | |
| 4,445,699 | 5/1984 | Darasko | 280/11.23 |
| 4,598,918 | 7/1986 | Rodriquez . | |
| 4,708,079 | 11/1987 | Magnan . | |
| 4,768,793 | 9/1988 | Spencer . | |
| 4,928,982 | 5/1990 | Logan | 280/11.22 |
| 5,106,110 | 4/1992 | Williamson . | |
| 5,251,920 | 10/1993 | McHale | 280/11.22 |
| 5,303,940 | 4/1994 | Brandner . | |
| 5,312,120 | 5/1994 | Wiegner | 280/11.27 |
| 5,411,277 | 5/1995 | Pratt . | |
| 5,452,907 | 9/1995 | Meibock et al. . | |
| 5,527,048 | 6/1996 | Conte | 280/11.2 |
| 5,566,957 | 10/1996 | Ho | 280/11.22 |

FOREIGN PATENT DOCUMENTS

| | | |
|---|---|---|
| 615225 | 4/1926 | France . |
| 215734 | 2/1909 | Germany . |
| 3911 899 | 10/1990 | Germany . |

*Primary Examiner*—Lanna Mai
*Assistant Examiner*—Frank Vanaman
*Attorney, Agent, or Firm*—Blakely, Sokoloff, Taylor & Zafman LLP

[57] ABSTRACT

A two-wheeled roller skate with canted wheels has an axle for the forward wheel located well forward of the ball of the foot. The axle for the rear wheel is located at the rear of the skater's heel. The wheels are canted so that the front and rear wheels contact the ground on the opposite sides of the center line of the skater's foot. In plan projection, the axles are preferably non-parallel in order to provide steering correction. The amount of steering correction desirable will depend on the skater's skill and the nature of the skating activity. In alternative embodiments, the present invention incorporates novel braking mechanisms.

20 Claims, 6 Drawing Sheets

10
12
15
14
16
17

10
12
16
14
15
18
17

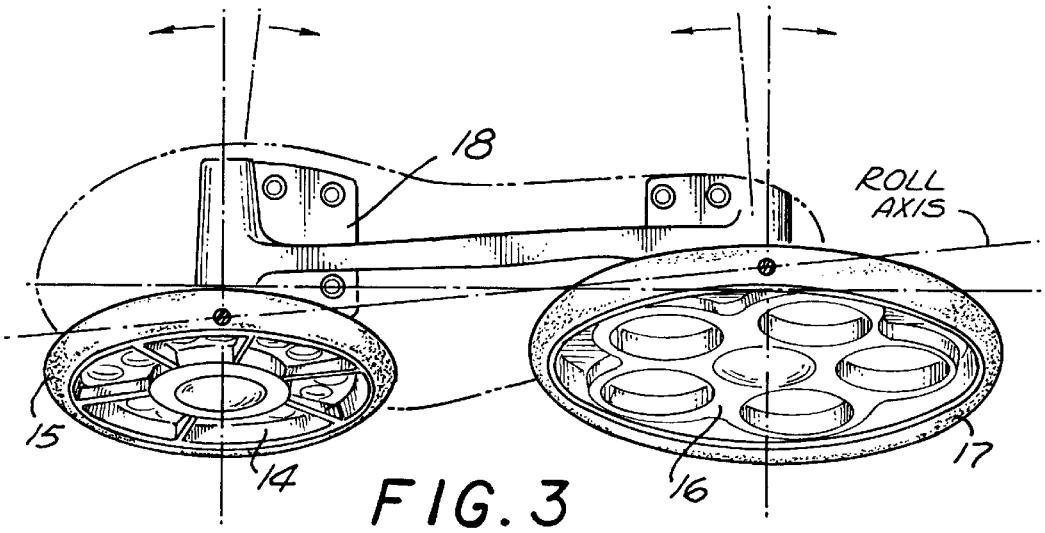
FIG. 3
FIG. 4
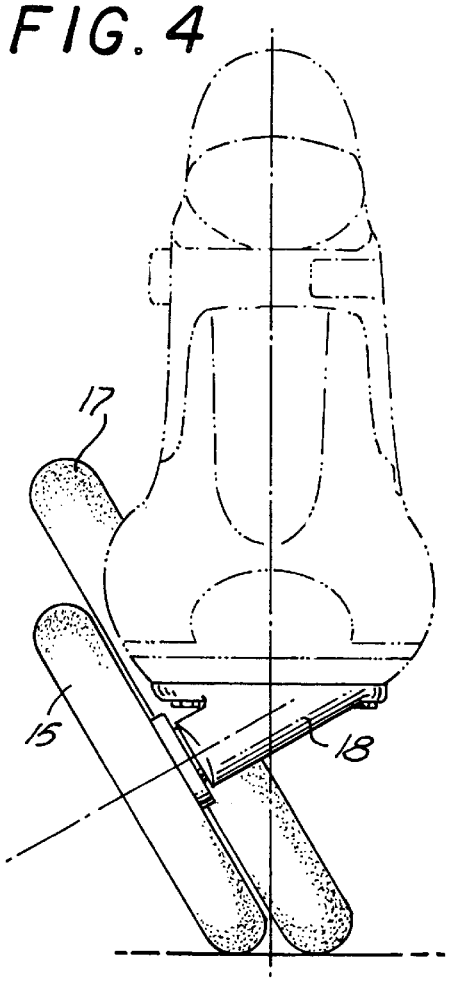
FIG. 5
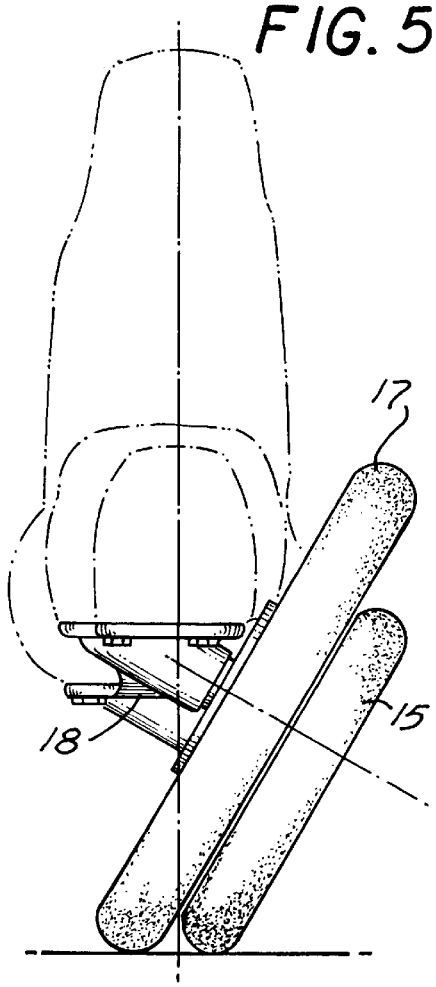

ROLLER SKATE

BACKGROUND OF THE INVENTION

1. Field of the Invention

This invention relates to the field of roller skates and, particularly, to an improved skate with canted, large diameter wheels.

2. Prior Art

Various designs of roller skates have been developed over the years. At the present time, "in-line" skates are particularly popular. This type of skate has a plurality of small-diameter wheels aligned in a longitudinal direction beneath the sole of the skater's foot. A number of advantages are claimed for this design of a skate. However, the small diameter of the wheels inherently limits the speed that can be achieved and limits the use of the skates to relatively smooth surfaces.

Among alternative skate designs, skates with large-diameter wheels have been proposed for over a century. For example, U.S. Pat. No. 89,833 discloses a skate with a single wheel of large diameter for use in skating on fields and other uneven surfaces. This skate, and many similar prior art designs, places the wheel to the outside of the skater's foot. While this allows a lower center of gravity than if the wheel were to be located entirely below the skater's foot, undue strain is placed on the skater's ankles because of the lateral offset between the center line of the skater's foot and the point of contact between the wheel and the ground. One solution to this problem is to mount the wheel at an angle with respect to vertical so that the point of contact with the ground will be directly below the skater's foot. Such a design for a single-wheeled skate is shown, for example, in U.S. Pat. No. 2,931,012.

Single-wheeled skates are, of course, inherently unstable. A design for a skate with two large diameter wheels is shown in U.S. Pat. No. 3,885,804 to Cudmore. In this design, two large, canted, equal-sized wheels are mounted on axles extending outwardly from a rigid sole-plate. As disclosed by Cudmore, the canted wheels contact the ground directly beneath the center line of the sole-plate. The wheels are dished with their concave sides facing toward the sole-plate so that a portion of the sole-plate extends into the wheel concavities to permit the sole-plate to be positioned very close to the ground. Cudmore's design provides a reasonably stable skate in comparison to many of the prior art designs; however, development of the present invention has yielded improved stability and responsiveness over the design of Cudmore. Furthermore, the dished wheels used by Cudmore to achieve a low center of gravity inherently limit the ability to turn sharply since the outside surfaces of the wheels will contact the ground when the skate leans in a sharp turn. The present invention overcomes this disadvantage by positioning the wheels so that dishing is not necessary to achieve an acceptably low center of gravity.

SUMMARY OF THE INVENTION

The present invention is a two-wheeled roller skate with canted wheels. In a preferred embodiment, the axle for the forward wheel is located well forward of the ball of the foot, approximately in line with the skater's toes. The axle for the rear wheel is located at the rear of the skater's heel. The wheels are canted so that the front wheel contacts the ground slightly outside of the center line of the skater's foot and the rear wheel contacts the ground slightly inside of the center line. This contact geometry permits the use of a relatively small diameter front wheel and thereby allows the sole of the skate to be positioned close to the ground. In plan projection, the axles are preferably non-parallel in order to provide steering correction. The amount of steering correction desirable will depend on the skater's skill and the nature of the skating activity. In alternative embodiments, the present invention incorporates novel braking mechanisms.

BRIEF DESCRIPTION OF THE DRAWINGS

FIG. 3 is a partial bottom plan view of the roller skate of FIG. 1.

FIG. 4 is a partial front elevational view of the roller skate of FIG. 1.

FIG. 5 is a partial rear elevation view of the roller skate of FIG. 1.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
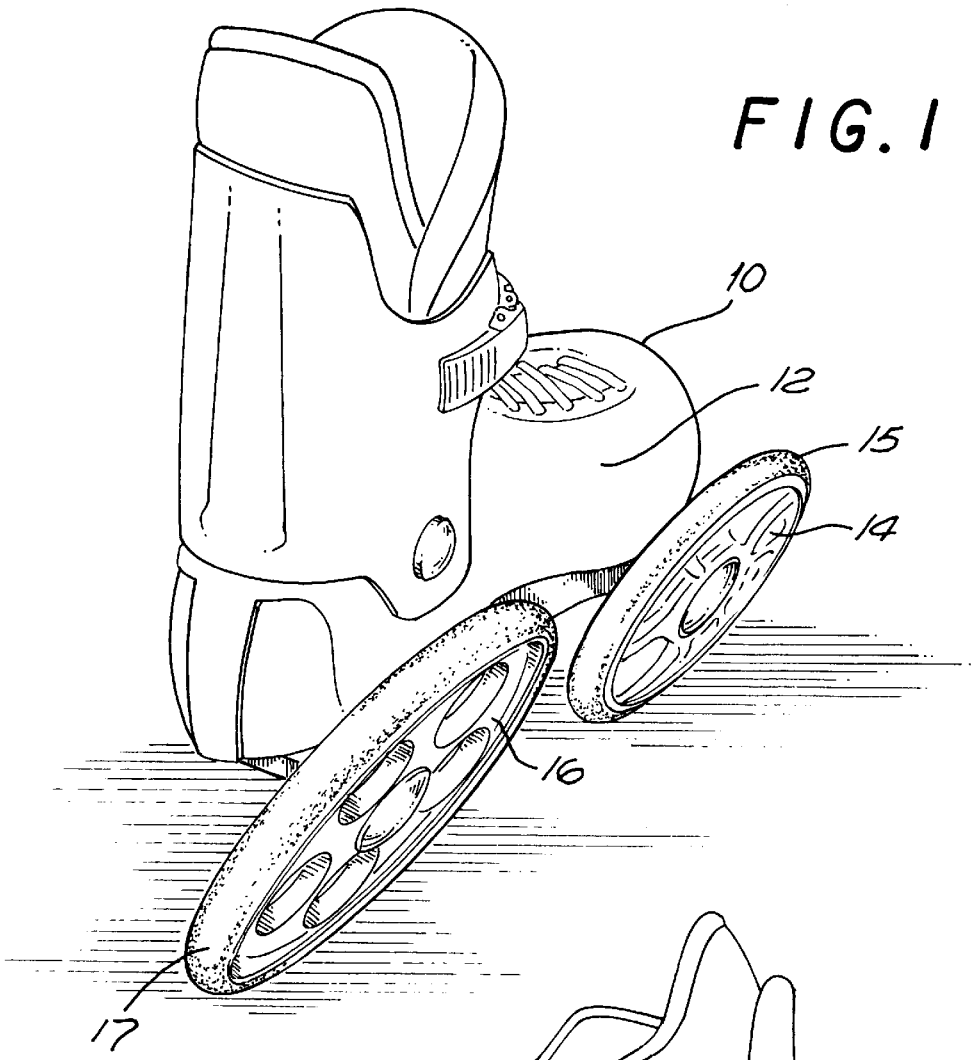
FIG. 1 is a perspective view of the roller skate constructed in accordance with the present invention.
Figure 12A:
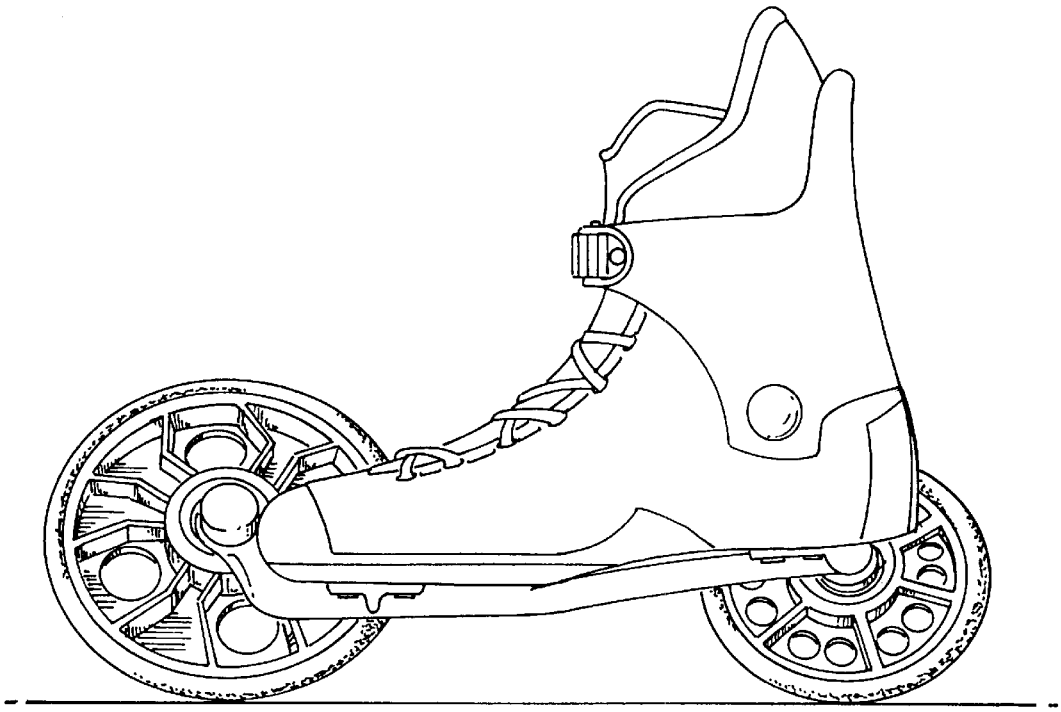
FIG. 12*a* is a side elevational view of a further alternative embodiment of the present invention.
Figure 12B:
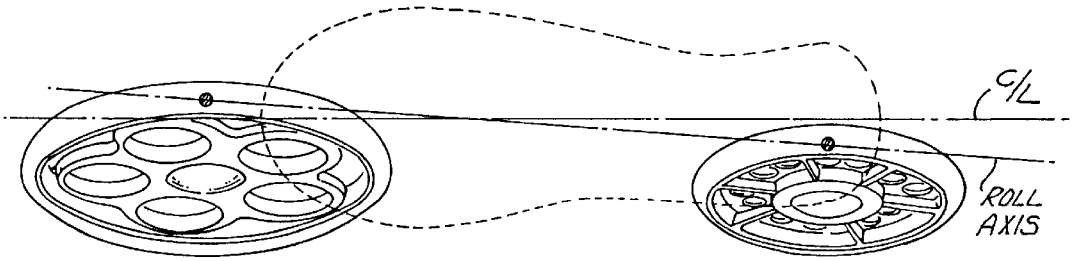
FIG. 12*b* illustrates the ground contact geometry of the embodiment shown in FIG. 12*a*.

FIG. 1 is a perspective view of a skate 10 constructed in accordance with the present invention. Skate 10 comprises a boot 12 to which are attached a front wheel 14 and a rear wheel 16. The front wheel 14 carries tire 15 and rear wheel 16 carries tire 17. In a preferred embodiment, the outside diameter of front tire 15 is about five inches and that of rear tire 17 is about seven inches. The invention is not limited in this regard and other sized or equal-sized wheels/tires may be used. In some embodiments, such as illustrated in FIG. 12, the front wheel/tire may have a larger diameter than the rear.

Skate 10 is intended for the right foot of the skater, thus wheels 14 and 16 are mounted to the outside of boot 12. It is to be understood that a corresponding skate is also provided for the left foot of the skater, which is generally a mirror image of skate 10. As will be more apparent in the discussion that follows, wheels 14 and 16 are canted so that tires 15 and 17 contact the ground directly beneath boot 12 rather than to the outside thereof.

Boot 12 is generally constructed in the same manner as boots used with conventional in-line skates. Accordingly, details of boot 12 will not be discussed herein. Wheels 14 and 16 may be machined or cast using a suitable metal or plastic material. Tires 15 and 17 may be made of a natural or synthetic rubber material and may be solid, foam-filled or pneumatic. Tires 15 and 17 may also be made of urethane plastic as has become standard practice for in-line skate wheels.

Figure 2:
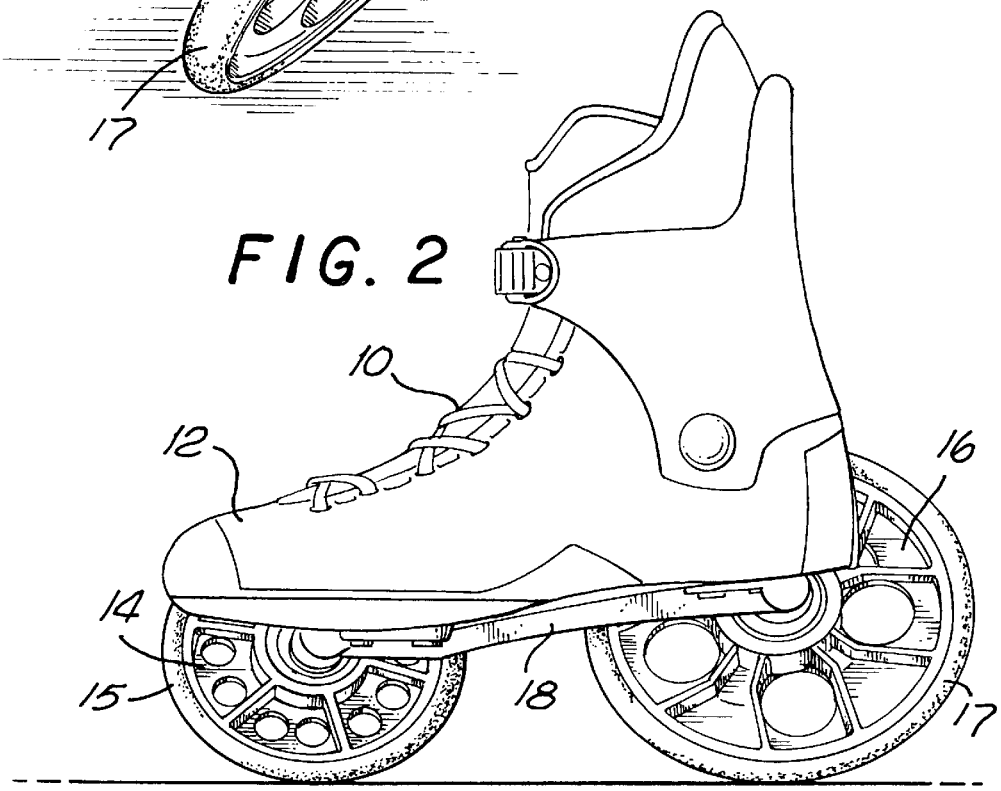
FIG. 2 is a side elevational view of the roller skate of FIG. 1.

FIG. 2 is an inside elevation view of skate 10. A sole plate or chassis 18 is attached to the bottom of boot 12 to provide structural support for wheels 14 and 16. Alternatively, boot 12 and chassis 18 could be an integral structure. The axle supporting front wheel 14 is located well forward of the ball of the skater's foot, either ahead of or in line with the skater's toes. The axle supporting rear wheel 16 is located generally below the skater's heel.

Referring now to FIG. 3, chassis 18 is shown in bottom plan view. When projected in plan view, the axles of wheels 14 and 16 are generally perpendicular to the center line of the skate. It has been found, however, that superior skating performance is achieved with slight "toe-in" of the front wheel and/or "toe-out" of the rear wheel as indicated by the arrows in FIG. 3. This provides a desirable steering correction to counteract the tendency of the skate to steer outwardly due to the offset geometry of the wheel-to-ground contact patches as described below. It has been determined that neutral handling (i.e., the situation where the skate tracks straight ahead while coasting) is best achieved with the rear wheel parallel to the skate center line and the front wheel toed in at about 2°.

For more experienced skaters, who desire power plus control and greater hill-climbing ability, a larger toe-in angle up to about 3° or 4° is preferred at the front wheel. This causes the left skate to steer slightly to the right and the right skate to steer slightly to the left and allows the skater to cover a greater distance with each push-off. The optimum configuration for all-around skating has been found to be a toe-out angle at the rear wheel of about 1°–1.5° and an equal amount of toe-in angle at the front wheel.

Each skater, depending upon experience and the nature of the terrain to be traversed, may prefer a slightly different adjustment of wheel angles. Indeed, the desirable range of wheel angles extends from 0° to about 5°. Therefore, it may be useful to provide a manual adjustment for toe-in of the front wheel and/or toe-out of the rear wheel within this range as indicated by the arrows in FIG. 3.

FIGS. 4 and 5 are front and rear elevational views, respectively, of skate 10. Projected in this plane, it can be seen that the axles of the front and rear wheels are substantially parallel. It is important to observe that front tire 15 contacts the ground to the outside of the center line of the skate, whereas rear tire 17 contacts the ground to the inside of the center line of the skate. The lateral offset of the front and rear contact patches is approximately equal at about ½ inch from the center line. In an alternative embodiment, such as that shown in FIG. 12, the front contact patch may be inside of the center line and the rear contact patch to the outside of the center line. This would be the case particularly when the front wheel has a larger diameter than the rear wheel.

A line drawn through the front and rear contact patches defines the roll axis of the skate. Referring back to FIG. 3, it can be seen that the roll axis is angled outwardly from the longitudinal center line of the skate. This geometry contributes to the stability of the skate at rest by distributing the skater's weight laterally with respect to the center line.

Figure 6:
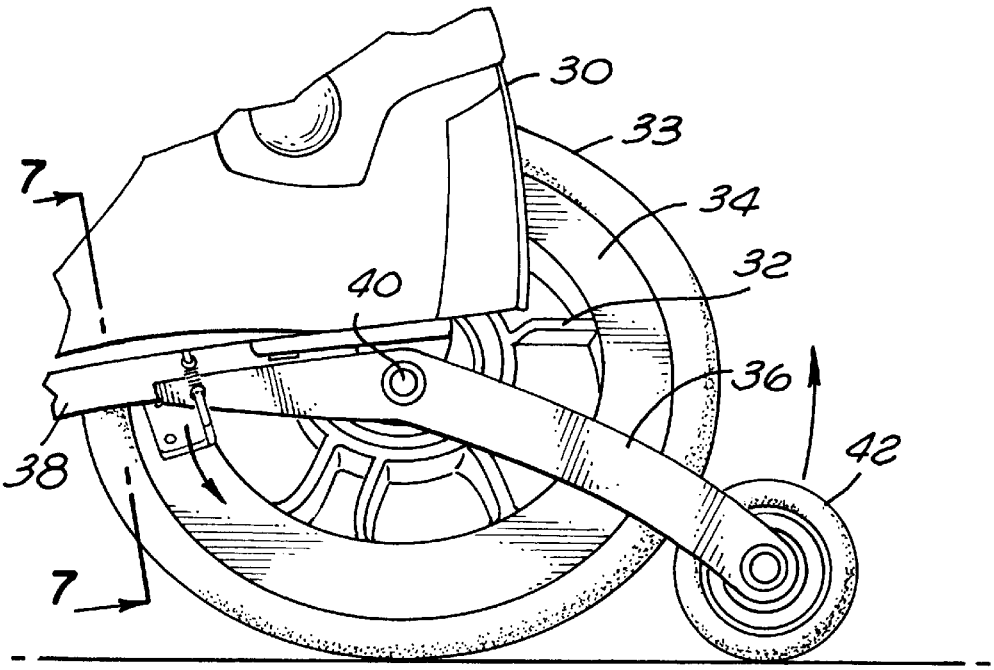
FIG. 6 is a partial side elevation view of an alternative embodiment of the present invention illustrating a braking mechanism.
Figure 7:
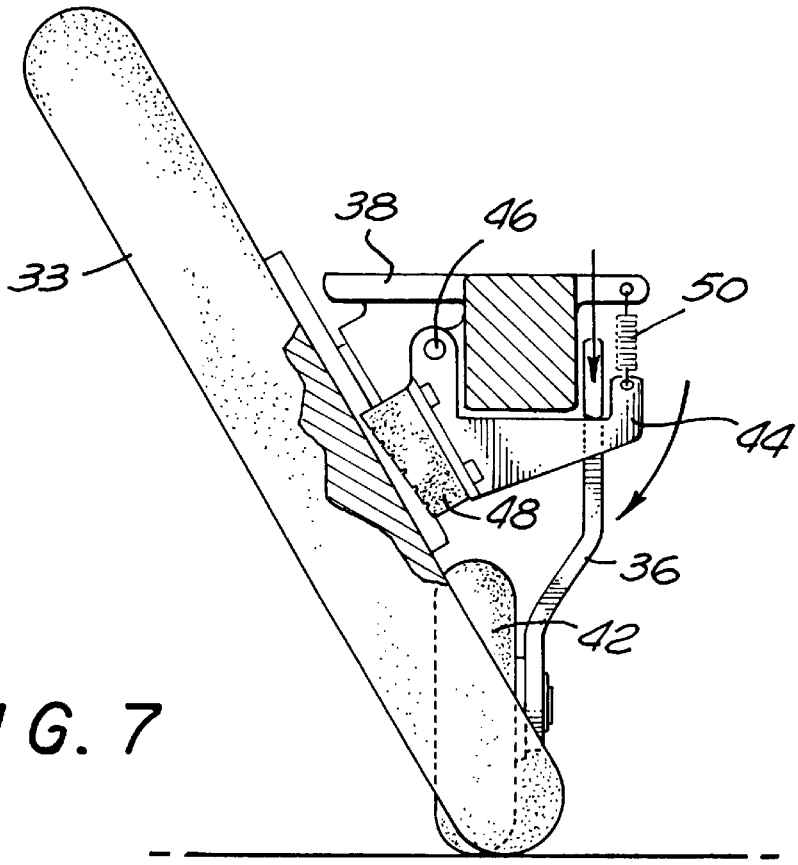
FIG. 7 is a cross-sectional view taken along line 7—7 of FIG. 6.

FIGS. 6 and 7 illustrate an optional braking mechanism for use with the present invention. Skate 30 includes rear wheel 32 and rear tire 33. Wheel 32 includes an annular braking surface 34. A lever 36 is pivotally connected to chassis 38 at pivot 40. A relatively small diameter wheel 42 is mounted at the rear end of lever 36 and contacts the ground surface traversed by skate 30. Alternatively, the rear end of lever 36 may have a simple skid for contacting the ground instead of wheel 42.

The forward end of lever 36 operatively engages brake lever 44, which is pivotally coupled to chassis 38 at pivot 46. Brake shoe 48 is rigidly attached to brake lever 44 with rivets or other suitable fasteners. Brake lever 44 is biased away from braking surface 34 by means of spring 50. To engage the brake while skating, the skater simply rotates the skate on which braking is desired about the axis of the rear wheel by shifting the skater's body weight. This causes lever 36 to rotate on pivot 40 and bear down on brake lever 44. This, in turn, urges brake shoe 48 into contact with braking surface 34. The amount of braking force applied is directly related to the amount by which skate 30 is rotated about the axis of rear wheel 32. It should be noted that this braking mechanism also has a beneficial stabilizing effect on skate 30 since it inherently limits the amount by which the skate can rotate about the axis of the rear wheel and thus helps prevent the skater from falling backwards.

Figure 8:
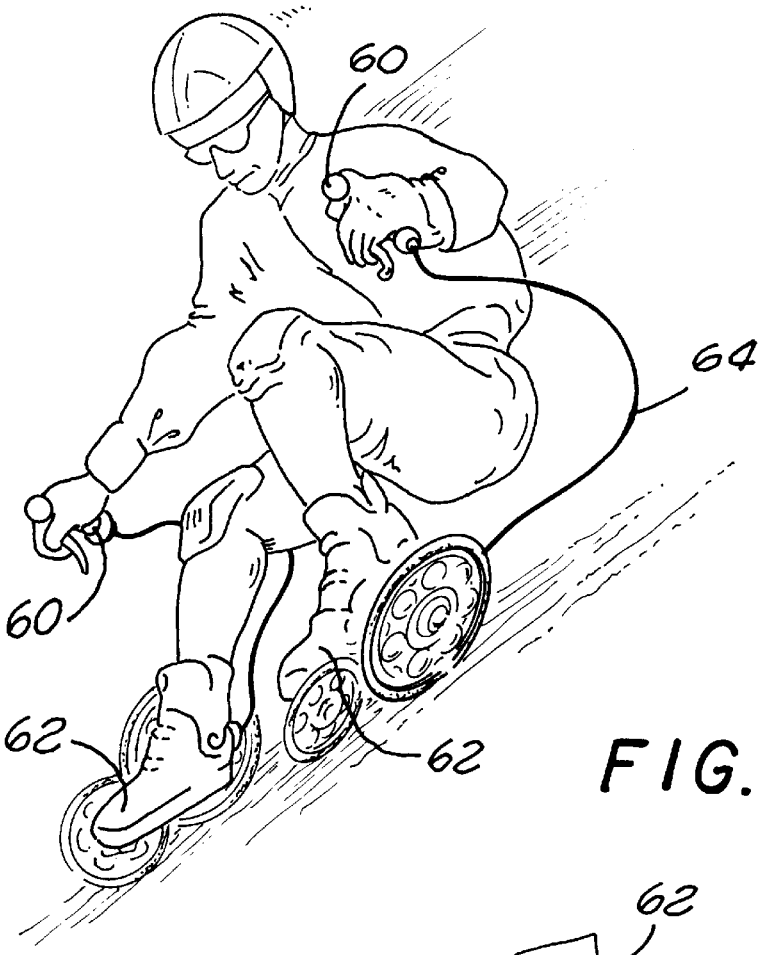
FIG. 8 is a perspective view of an other alternative embodiment of the present invention.

The braking system shown in FIGS. 6 and 7 is not ideally suited to use on uneven terrain. An alternative braking system is illustrated in FIG. 8. Here, brake actuation is effected by a pair of hand grips 60 coupled to respective skates 62. Each of hand grips 60 communicates with its respective skate by means of cable 64, which may be like a conventional bicycle brake cable for mechanical actuation of the brake. Alternatively, hand grips 60 may incorporate a hydraulic reservoir, in which case, hydraulic pressure is communicated through cable 64 to a hydraulic slave cylinder in skate 62.

Figure 9:
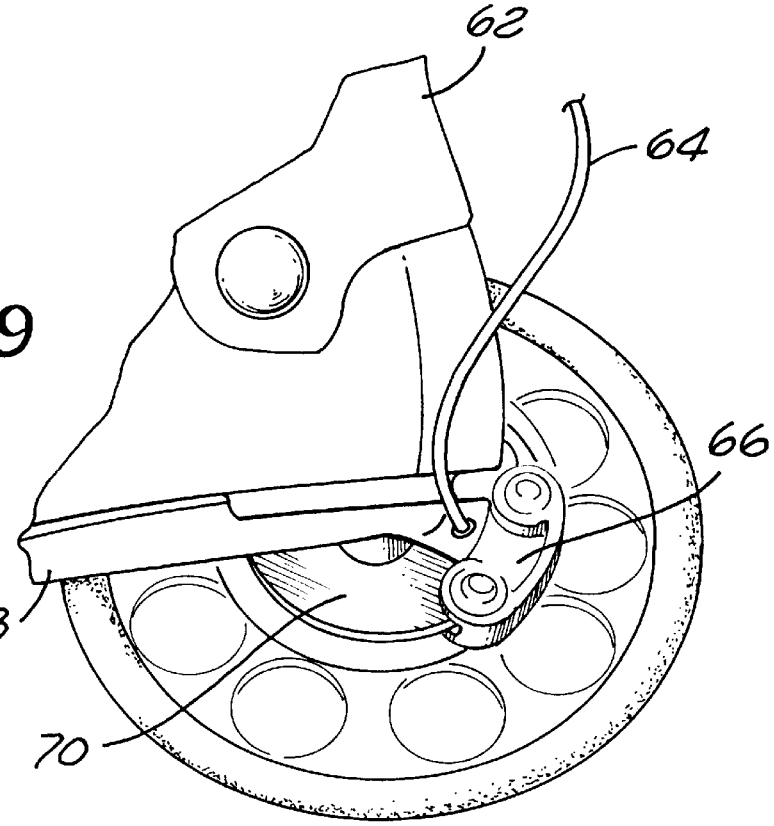
FIG. 9 is a partial side elevational view of the roller skate of FIG. 8.

FIG. 9 illustrates a hydraulic braking mechanism for skate 62. Hydraulic cable 64 communicates with brake caliper 66, which is rigidly mounted to chassis 68. Brake shoes (not shown) within caliper 66 exert a clamping force on brake disc 70 in a manner similar in operation to automotive disc brakes.

Figure 10:
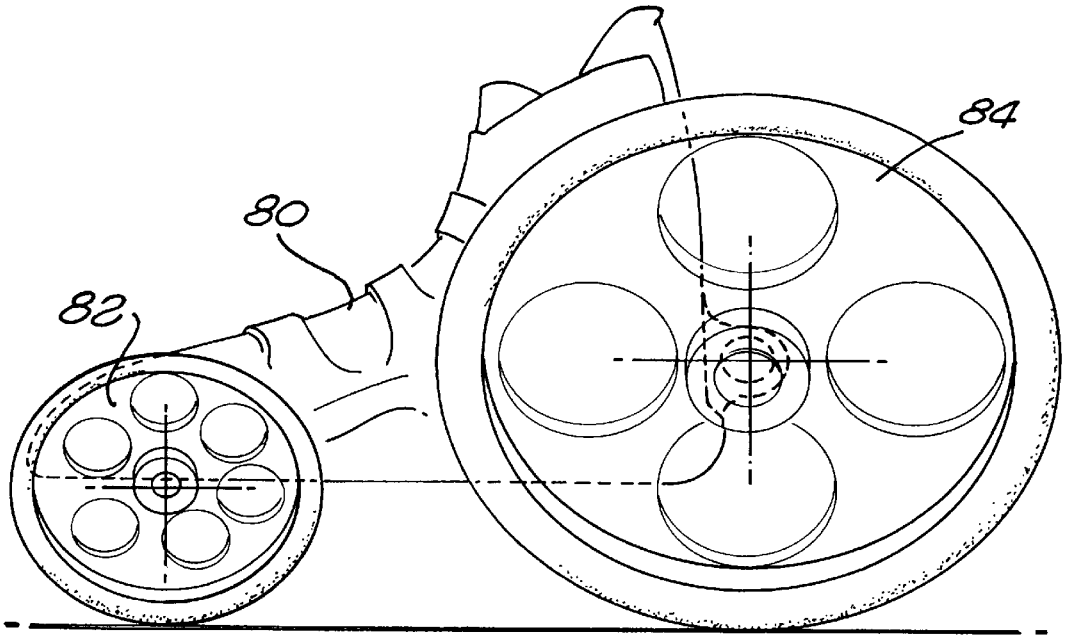
FIG. 10 is a side elevational view of yet another alternative embodiment of the present invention.

FIG. 10 illustrates an alternative embodiment of the present invention. Skate 80 has a front wheel 82 similar to that of the previously discussed embodiments. However, rear wheel 84 is substantially larger in diameter, which is desirable for speed skating. In the illustrated embodiment, rear wheel 84 has a diameter of approximately 10 inches. To accommodate a wheel of this size, the axle is located behind the skater's heel, thereby obviating the need to elevate the skater's foot higher above the ground.

Figure 11:
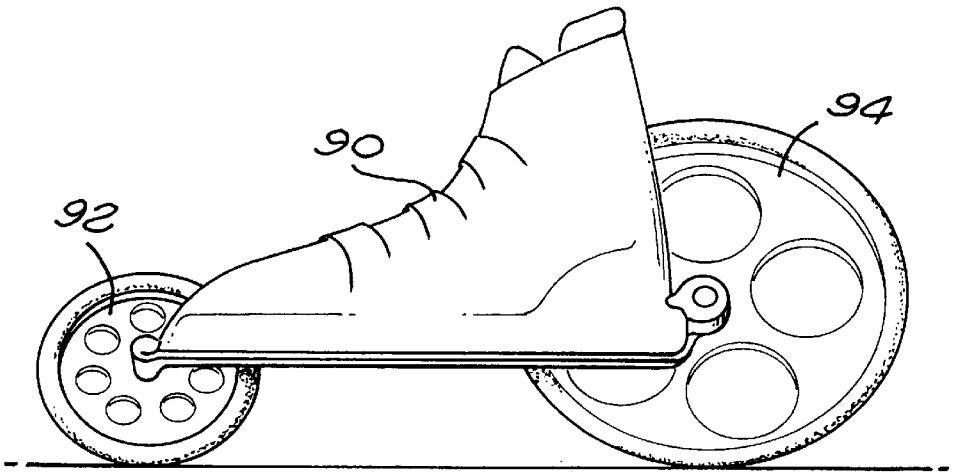
FIG. 11 is a side elevational view of still another alternative embodiment of the present invention.

FIG. 11 illustrates a further embodiment of the present invention that is a variation of the embodiment shown in FIG. 10. Skate 90 has a large diameter rear wheel 94 as in the previously discussed embodiment. In this embodiment, however, front wheel 92 is located forward of the skater's toe, which is desirable for high speed skating. Front wheel 92 may have a fixed location on skate 90 or a manual adjustment may be provided so that the skater can locate the axle of the front wheel longitudinally at a desired position within a range of adjustment.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A roller skate comprising:

a boot having a toe portion and a heel portion, both the toe and heel portions being generally bisected in plan view by a longitudinal center line of the boot defining an inside direction and an outside direction;

a front wheel rotatably mounted to the toe portion of the boot and disposed to the outside thereof for rotation about a first axis inclined with respect to horizontal;

a rear wheel rotatable mounted to the heel portion of the boot and disposed to the outside thereof for rotation about a second axis inclined with respect to horizontal;

said front and rear wheels supporting the boot above a ground surface, said front and rear wheels contacting the ground surface along a line defining a roll axis that intersects the longitudinal center line in plan view at an angle;

wherein the rear wheel has an outside diameter larger than an outside diameter of the front wheel.

2. The roller skate of claim 1 wherein the roll axis is angled outwardly in a forward direction from the longitudinal center line.

3. The roller skate of claim 1 wherein the outside diameter of the rear wheel is approximately seven inches and the outside diameter of the front wheel is approximately five inches.

4. The roller skate of claim 1 wherein the first and second axes are inclined approximately equally with respect to horizontal.

5. The roller skate of claim 1 wherein the first axis is at an oblique angle with respect to a line perpendicular to the center line in plan view.

6. The roller skate of claim 5 wherein the oblique angle is in the range of approximately 0.1° to 5°.

7. The roller skate of claim 6 wherein the oblique angle is adjustable.

8. The roller skate of claim 1 wherein the second axis is at an oblique angle with respect to a line perpendicular to the center line in plan view.

9. The roller skate of claim 8 wherein the oblique angle is in the range of approximately 0.1° to 5°.

10. The roller skate of claim 9 wherein the oblique angle is adjustable.

11. The roller skate of claim 1 wherein the front wheel contacts the ground surface to the outside of the longitudinal center line and the rear wheel contacts the ground surface to the inside of the longitudinal center line.

12. The roller skate of claim 1 wherein the first axis is located longitudinally forward of a ball portion of the boot.

13. A roller skate comprising:

a boot having a toe portion and a heel portion, both the toe and heel portions being generally bisected in plan view by a longitudinal center line of the boot defining an inside direction and an outside direction;

a front wheel rotatable mounted to the toe portion of the boot and disposed to the outside thereof for rotation about a first axis inclined with respect to horizontal;

a rear wheel rotatably mounted to the heel portion of the boot and disposed to the outside thereof for rotation about a second axis inclined with respect to horizontal;

said front and rear wheels supporting the boot above a ground surface, said front and rear wheels contacting the ground surface along a line defining a roll axis that intersects the longitudinal center line in plan view at an angle;

wherein the front wheel is rotatably mounted on a front axle and said front axle is disposed entirely below a sole of the boot; and wherein the front wheel has an outside diameter larger than an outside diameter of the rear wheel.

14. The roller skate of claim 13 wherein the front wheel contacts the ground surface to the inside of the longitudinal center line and the rear wheel contacts the ground surface to the outside of the longitudinal center line.

15. A roller skate comprising:

a boot having a toe portion and a heel portion, both the toe and heel portions being generally bisected in plan view by a longitudinal center line of the boot defining an inside direction and an outside direction;

a front wheel rotatable mounted to the toe portion of the boot and disposed to the outside thereof for rotation about a first axis inclined with respect to horizontal;

a rear wheel rotatable mounted to the heel portion of the boot and disposed to the outside thereof for rotation about a second axis inclined with respect to horizontal;

wherein the first axis is at an oblique angle with respect to a line perpendicular to the center line in the range of approximately 0.1° to 5°.

16. The roller skate of claim 15 wherein the oblique angle is adjustable.

17. The roller skate of claim 16 wherein the second axis is at an oblique angle with respect to a line perpendicular to the center line in the range of approximately 0.1° to 5°.

18. The roller skate of claim 17 wherein the oblique angle is adjustable.

19. The roller skate of claim 15 wherein the first axis is located longitudinally forward of a ball portion of the boot.

20. A roller skate comprising:

a boot having a sole, a toe portion, and a heel portion;

a front axle mounted to the toe portion having a first axis inclined with respect to horizontal;

a front wheel rotatably mounted on the front axle to an outside of the boot;

a rear axle mounted to the heel portion having a second axis inclined with respect to horizontal, said rear axle disposed entirely above the sole of the boot; and a rear wheel rotatably mounted on the rear axle to the outside of the boot.

* * * * *

UNITED STATES PATENT AND TRADEMARK OFFICE

CERTIFICATE OF CORRECTION

PATENT NO. : 5,951,028

DATED : September 14, 1999

INVENTOR(S) : Lovitt et al.

It is certified that error appears in the above-identified patent and that said Letters Patent is hereby corrected as shown below: On cover page, In item [56], References Cited, patent number 2,198,857, please delete "9/1940" and insert -- 9/1937 --.

In item [56], References Cited, patent number 2,520,793, please delete "10/1950" and insert -- 10/1946 --.

In item [56], Foreign Patent Documents, please delete reference number "3911 899" and insert -- DE 3911 899 --.

In claim 1, line 16, please delete "rotatable" and insert -- rotatably --.

In claim 13, line 3, please delete "rotatable" and insert -- rotatably --.

In claim 15. line 29 and32, please delete "rotatable" and insert -- rotatably --.

In claim 17, line 40, please delete "claim 16" and insert -- claim 15 --.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 5,951,028 Page 2 of 2

DATED : September 14,1999

INVENTOR(S) : Lovitt et al.

It is certified that error appears in the above-identified patent and that said Letters Patent is hereby corrected as shown below:

Please delete Figure 3, and insert attached Figure 3.

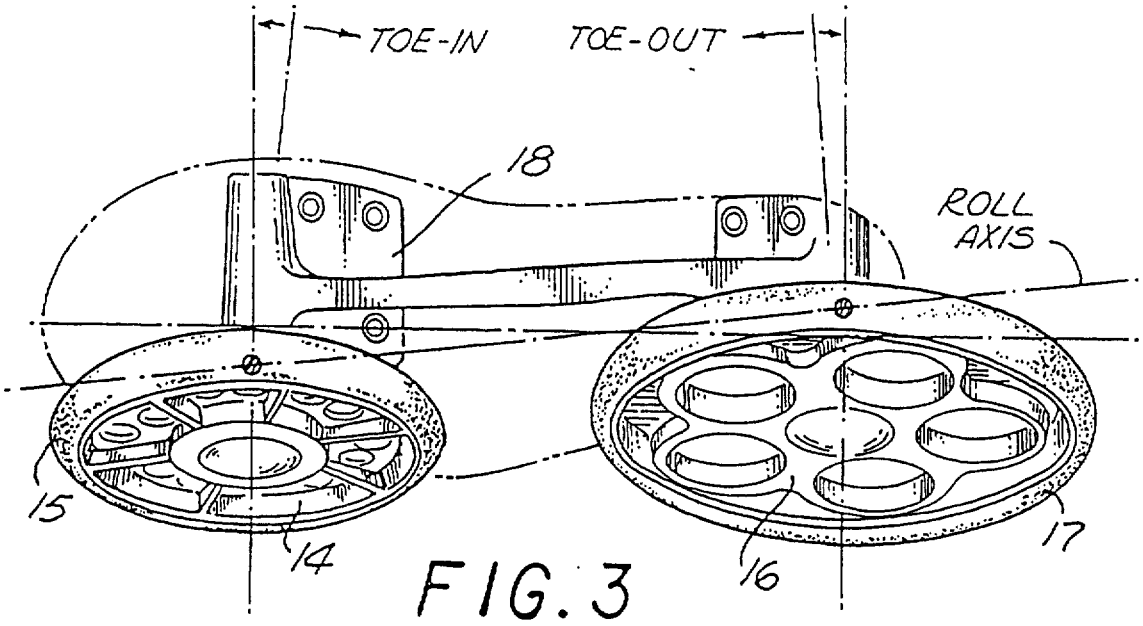

FIG. 3